US009427853B1

(12) United States Patent
Brodhead et al.

(10) Patent No.: US 9,427,853 B1
(45) Date of Patent: Aug. 30, 2016

(54) APPARATUS AND METHOD TO TORQUE FITTINGS

(71) Applicant: The Boeing Company, Chicago, IL (US)

(72) Inventors: James Eric Brodhead, Everett, WA (US); Raymond L. Kroll, Kent, WA (US); Brenda K. Carlson, Bothell, WA (US)

(73) Assignee: The Boeing Company, Chicago, IL (US)

( * ) Notice: Subject to any disclaimer, the term of this patent is extended or adjusted under 35 U.S.C. 154(b) by 461 days.

(21) Appl. No.: 13/919,762

(22) Filed: Jun. 17, 2013

(51) Int. Cl.
*B25B 23/142* (2006.01)

(52) U.S. Cl.
CPC ..... *B25B 23/142* (2013.01)

(58) Field of Classification Search
CPC . B25B 23/1427; B25B 13/06; B25B 23/141; B25B 23/142; B25B 23/145; B25B 13/12; E21B 19/166; E21B 19/162; E21B 19/164
See application file for complete search history.

(56) References Cited

U.S. PATENT DOCUMENTS

| | | | | |
|---|---|---|---|---|
| 2,882,773 | A * | 4/1959 | Wing | B25B 13/488 81/475 |
| 6,490,952 | B2 * | 12/2002 | Junkers | 81/57.39 |
| 7,188,552 | B1 * | 3/2007 | Koppenhoefer | B25B 13/06 81/125 |
| 7,950,309 | B2 * | 5/2011 | Junkers | B25B 13/488 81/55 |
| 2006/0117915 | A1 * | 6/2006 | Hui | B25B 13/06 81/124.4 |
| 2007/0227315 | A1 * | 10/2007 | Provost | B25B 21/00 81/467 |

OTHER PUBLICATIONS

Mountz Torque Multipliers Overview, www.mountztorque.com/products/torque-multipliers, 2013.

* cited by examiner

*Primary Examiner* — Robert Scruggs
(74) *Attorney, Agent, or Firm* — Toler Law Group, PC

(57) ABSTRACT

Manufacturing systems and methods are disclosed. In one example, an apparatus to apply a predetermine torque to a fitting having a head and a nut engageable with the head is provided. The apparatus includes a driveshaft, configured to be arranged concentrically with an axis and to be rotatable about the axis, a first socket, configured to be arranged concentrically with the axis and to receive the head, and a second socket, configured to receive the nut and to be rotatable relative to the first socket by the driveshaft.

20 Claims, 8 Drawing Sheets

APPARATUS AND METHOD TO TORQUE FITTINGS

BACKGROUND

The subject matter described herein relates to manufacturing techniques and more particularly to apparatus and methods to torque fittings.

Various manufacturing operations require fittings on opposing sides of a structure to be secured to a torque threshold. By way of example, some bulkhead fittings in vehicles, such as aircraft and watercraft, include a sleeve which passes through a hole in the bulkhead. One end of the fitting includes a fixed head, while the other end of the fitting is threaded to accept a nut. Existing methods of securing the fitting require two mechanics, one on each side of the bulkhead, to torque the fitting to a torque threshold. In some circumstances the work environment is cramped, which renders the task difficult and time consuming.

SUMMARY

Accordingly, apparatus and methods to torque fittings may find utility.

In one example, an apparatus to apply a predetermined torque to a fitting having a head and a nut, threadably engageable with the head, is disclosed. The apparatus includes a driveshaft, configured to be arranged concentrically with an axis and to be rotatable about the axis, a first socket, configured to be arranged concentrically with the axis and to receive the head, and a second socket, configured to receive the nut and to be rotatable relative to the first socket by the driveshaft.

In another example, a method to apply a predetermined torque to a preinstalled fitting having a head and a nut, threadably engageable with the head, is provided. The method includes rotatably coupling a first socket to a driveshaft, inserting the driveshaft through the head and the nut, engaging the first socket with the head, coupling a second socket to the driveshaft without relative rotational motion therebetween. engaging the second socket with the nut, and rotating the driveshaft and the second socket in a direction opposite to that the fitting is threaded, while preventing rotation of the first socket.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

Examples of methods and systems in accordance with the teachings of the present disclosure are described in detail below with reference to the following drawings.

DETAILED DESCRIPTION

Apparatus and methods to torque fittings are described herein. In some examples, apparatus and methods described herein may be used in the manufacture of vehicles such as aircraft, ships, automobiles, or any other structures in which fittings may be installed on opposing sides of a structural member. By way of example, aircraft structures commonly include one or more bulkheads formed from metal or composite materials. During the manufacturing process, one or more fittings may be installed in a bulkhead, for example, to allow fuel lines, conduit, or the like to pass through the bulkhead. Apparatus and methods described herein facilitate the installation of such fittings.

Figure 1:
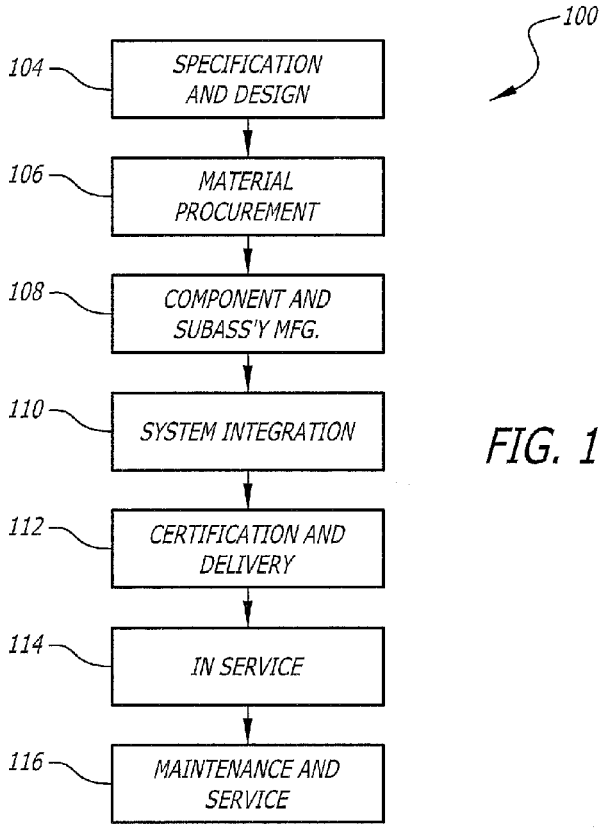
FIG. 1 is a flow diagram of aircraft production and service methodology.
Figure 2:
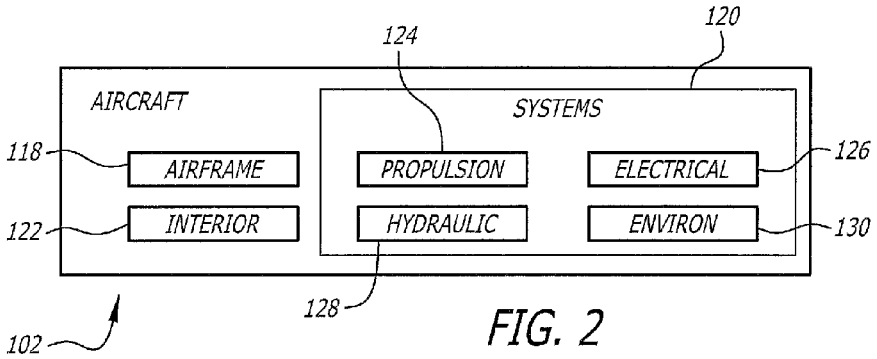
FIG. 2 is a block diagram of an aircraft.

Referring more particularly to the drawings, aspects of the disclosure may be described in the context of an aircraft manufacturing and service method 100 as shown in FIG. 1 and an aircraft 102 as shown in FIG. 2. During pre-production, an illustrative method 100 may include specification and design 104 of the aircraft 102 and material procurement 106. During production, component and sub-assembly manufacturing 108 and system integration 110 of the aircraft 102 takes place. Thereafter, the aircraft 102 may go through certification and delivery 112 in order to be placed in service 114. While in service by a customer, the aircraft 102 is scheduled for routine maintenance and service 116 (which may also include modification, reconfiguration, refurbishment, and so on).

Each of the processes of method 100 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 2, the aircraft 102 produced by the illustrative method 100 may include an airframe 118 with a plurality of systems 120 and an interior 122. Examples of high-level systems 120 include one or more of a propulsion system 124, an electrical system 126, a hydraulic system 128, and an environmental system 130. Any number of other systems may be included. Although an aerospace example is shown, the principles of the disclosure may be applied to other industries, such as the automotive industry.

Apparatus and methods embodied herein may be employed during any one or more of the stages of the production and service method 100. For example, components or subassemblies corresponding to production process 108 may be fabricated or manufactured in a manner similar to components or subassemblies produced while the aircraft 102 is in service. Also, one or more apparatus examples, method examples, or a combination thereof may be utilized during the production stages 108 and 110, for example, by substantially expediting assembly of or reducing the cost of an aircraft 102. Similarly, one or more of apparatus examples, method examples, or a combination thereof may be utilized while the aircraft 102 is in service, for example and without limitation, to maintenance and service 116.

Figure 3A:
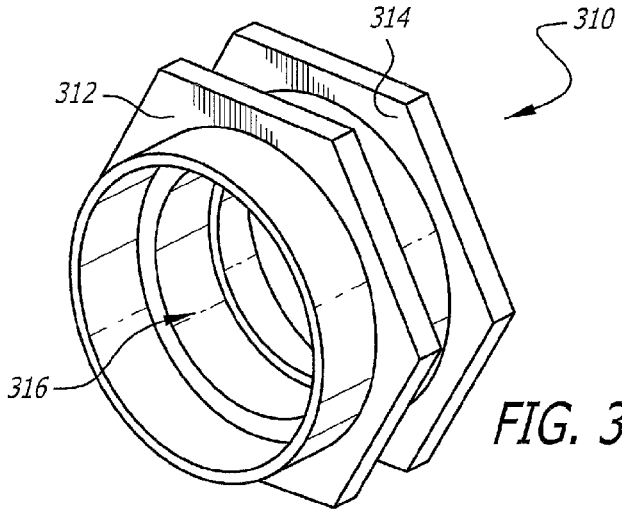
FIGS. 3A-3B are schematic illustrations of an illustrative fitting, according to an aspect of the disclosure.
Figure 3B:
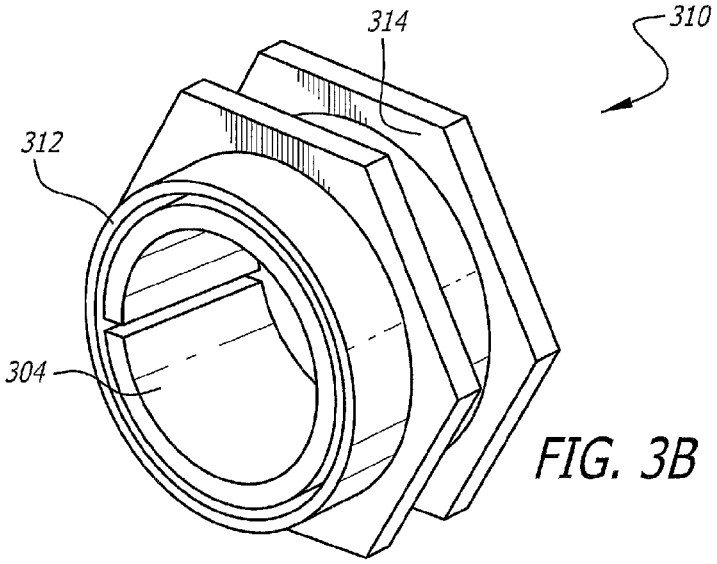

As described above, during the manufacturing process, one or more fittings may be installed in a bulkhead, for example, to allow fuel lines, conduit, or the like to pass through the bulkhead. FIGS. 3A-3B are schematic illustrations of an illustrative fitting, according to one or more aspects of the disclosure. Referring to FIGS. 3A-3B, in some examples, a fitting 310 includes a head 312 and a nut 314 which may be threadably engagable with the head 312. In the examples depicted in FIGS. 3A-3B, the head 312 and the nut 314 each have a hexagonal or an otherwise-shaped surface defined such that both the head and the nut may be engaged by a suitable installation/removal tool, e.g., a socket or a wrench. Conduits, pipes, or the like may be secured to the fitting 310. The fitting 310 defines an inner diameter 316, through which fluids, wires, or other materials may pass. The specific dimensions of the fitting 310 are not critical. In various examples described herein, an apparatus to torque fittings, such as the fitting 310, may be embodied as a tool which may be coupled to a driving device. In brief, the tool may include a driveshaft, attached to the driving device. The driveshaft is rotatable about an axis and is adapted to extend through the fitting. A first socket may be mounted about the driveshaft to receive the head of the fitting. The driveshaft may be extended through the fitting and a second socket may be mounted about the driveshaft to receive the nut of the fitting. Rotating the driveshaft introduces relative rotational motion between the head and the nut to torque the fitting.

FIGS. 4A-4I are schematic illustrations of an apparatus for torquing fittings, according to one or more aspects of the disclosure. Referring to FIGS. 4A-4H, in some examples, an apparatus 400 to apply a predetermine torque to a fitting, such as the fitting 310 (FIG. 3A), having the head 312 and the nut 314, threadably engageable with the head 312, is disclosed. The apparatus 400 includes a driveshaft 420, configured to be arranged concentrically with an axis 402 and to be rotatable about the axis 402, a first socket 430 (e.g., FIG. 4B), configured to be arranged concentrically with the axis 402 and to receive the head 312 (FIG. 4C) of the fitting, and a second socket 440 (e.g., FIG. 4D) configured to receive the nut 314 (e.g., FIG. 4C) of the fitting and to be rotatable relative to the first socket 430 by the driveshaft 420.

The driveshaft 420 is configured to extend through the fitting 310, which may be fitted with a protective sleeve 304 (FIG. 3B) to prevent the driveshaft 420 from damaging the inner diameter 316 of the fitting 310.

Figure 4B:
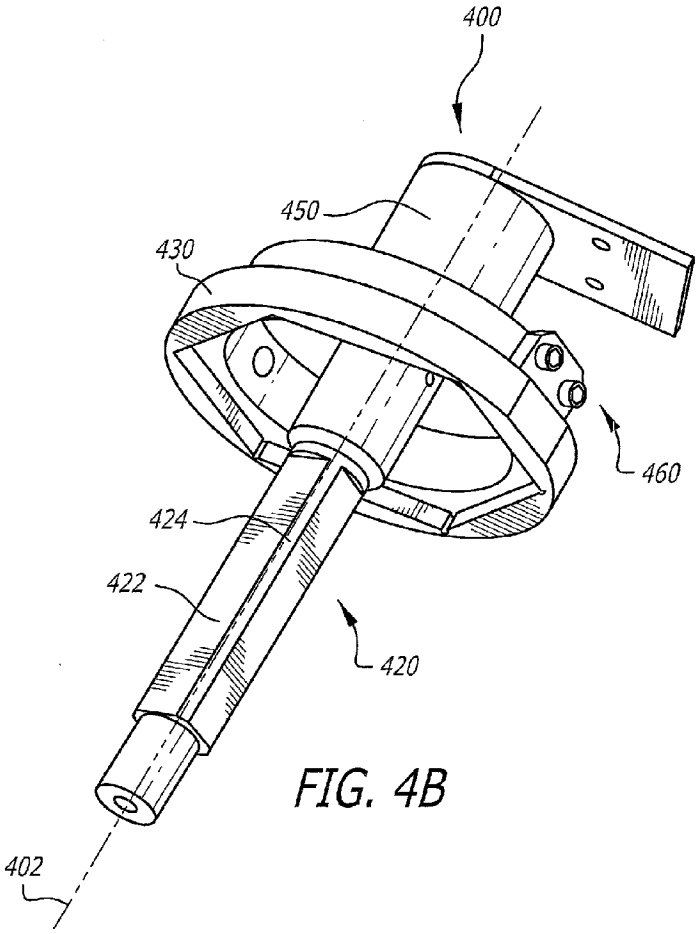
FIGS. 4A-4I are a schematic illustrations of an apparatus to torque fittings according to one or more aspects of the disclosure.
Figure 4A:
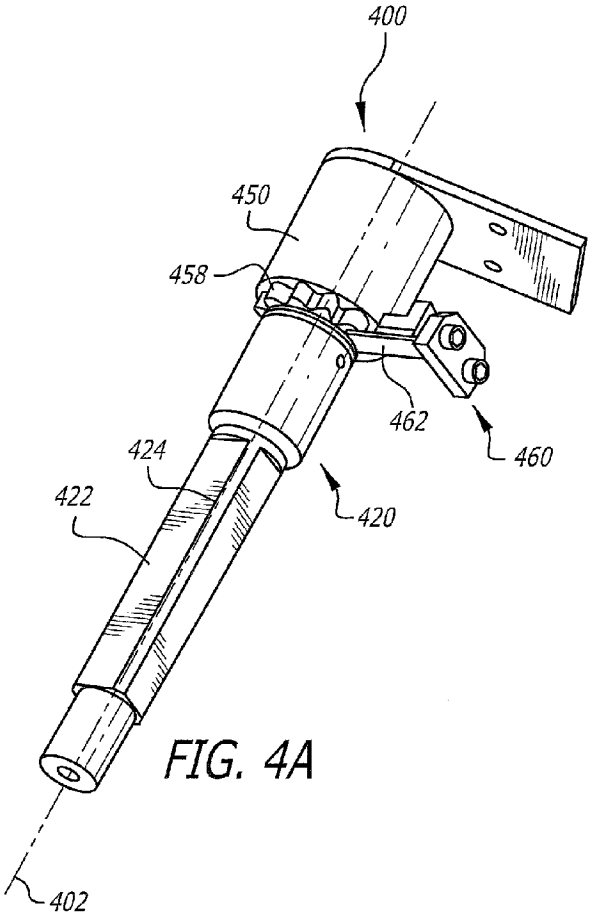
Figure 4D:
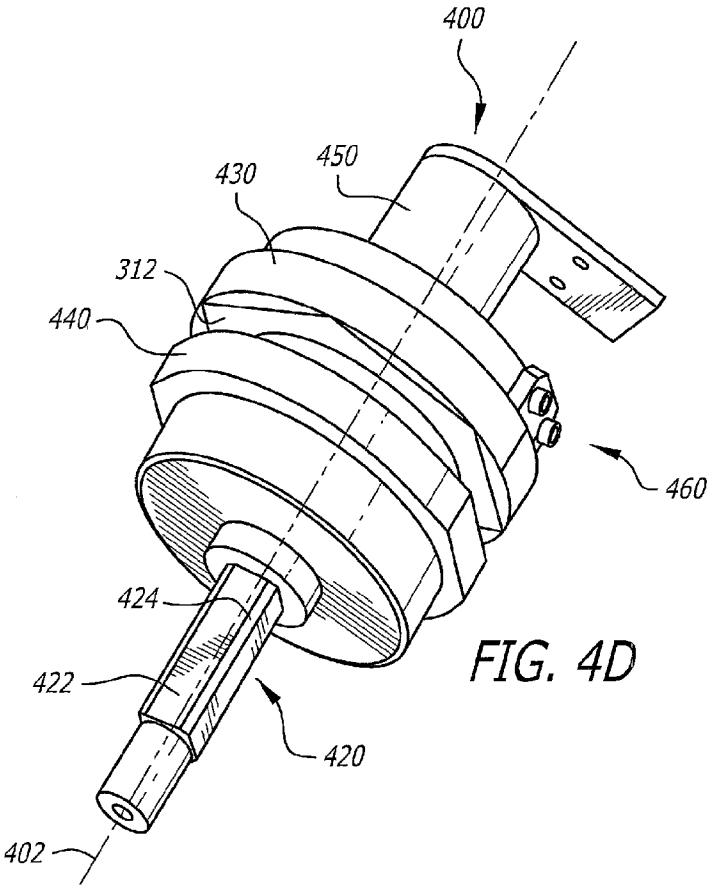
Figure 4C:
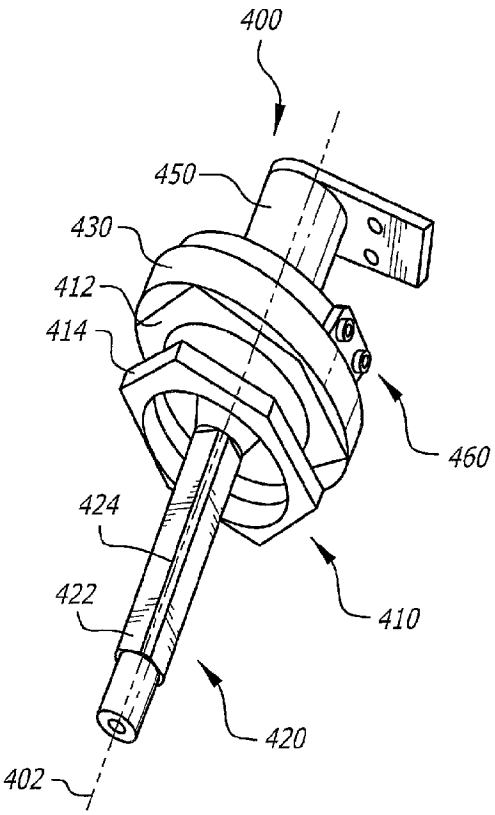

As illustrated, for example, in FIG. 4A, in one aspect of the disclosure, the driveshaft 420 includes a first surface 422, configured to engage the second socket 440 when the second socket 440 is slid onto the driveshaft. In some examples, the first surface 422 includes flat surfaces 422, which extend along the axis 402 and engage with an aperture in the second socket 440, such that second socket 440 may be slid onto the driveshaft 420 and such that rotating the driveshaft 420 also rotates the second socket 440. In the example depicted in FIGS. 4A-4G, the driveshaft 420 includes four flat surfaces 422, such that the section of the driveshaft 420 including the flat surfaces 422 presents, e.g., a substantially square cross-section when viewed perpendicular to axis 402. However, the particular number of flat surfaces is not critical.

Figure 4E:
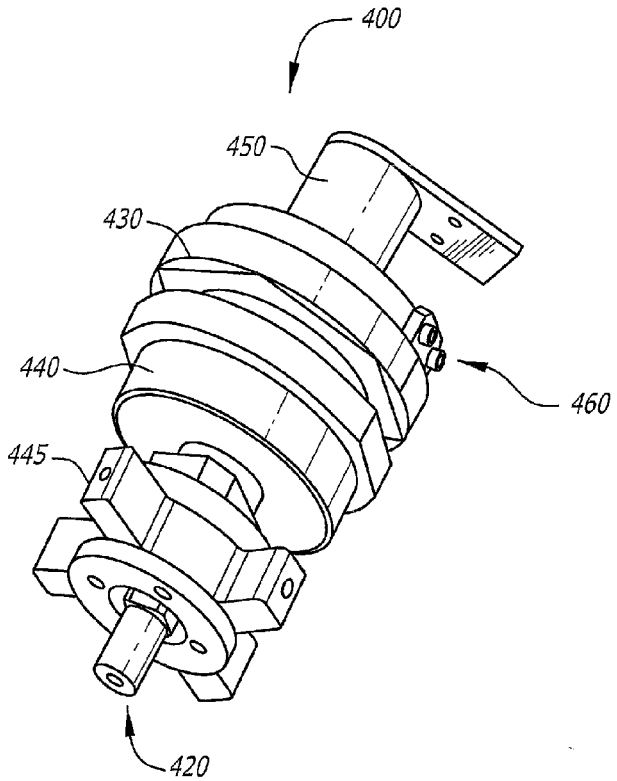
Figure 4F:
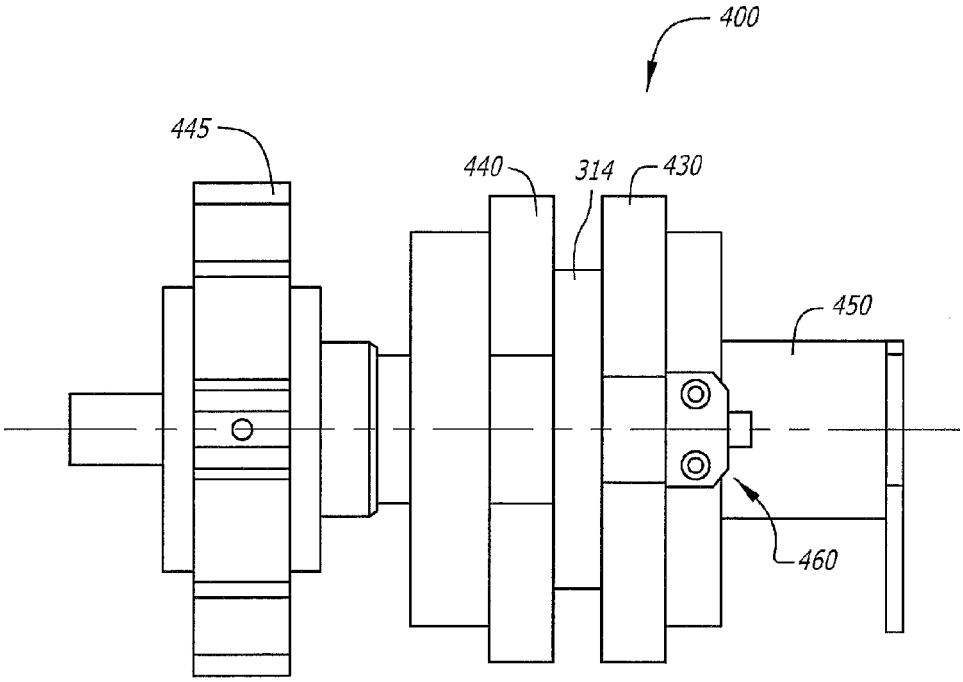
Figure 4G:
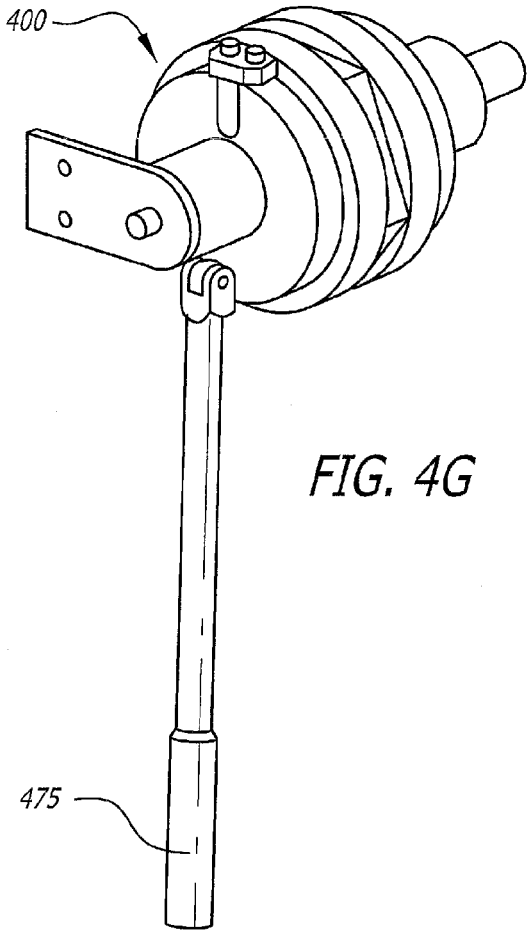

Driveshaft 420 further includes one or more curved surfaces 424, configured to threadably engage a retaining nut 445 (FIGS. 4E, 4F). In some examples, the curved surface(s) 424 also extend along the axis 402 adjacent the first surface(s) 422 to define a partial cylindrical profile. The curved surface may be threaded to receive a retaining nut 445, which is threadably engagable with the driveshaft 420.

Figure 4H:
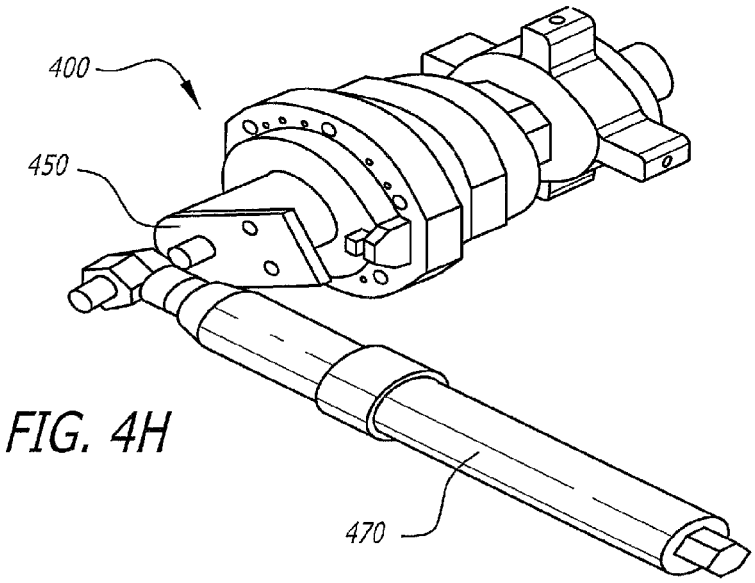
Figure 4I:
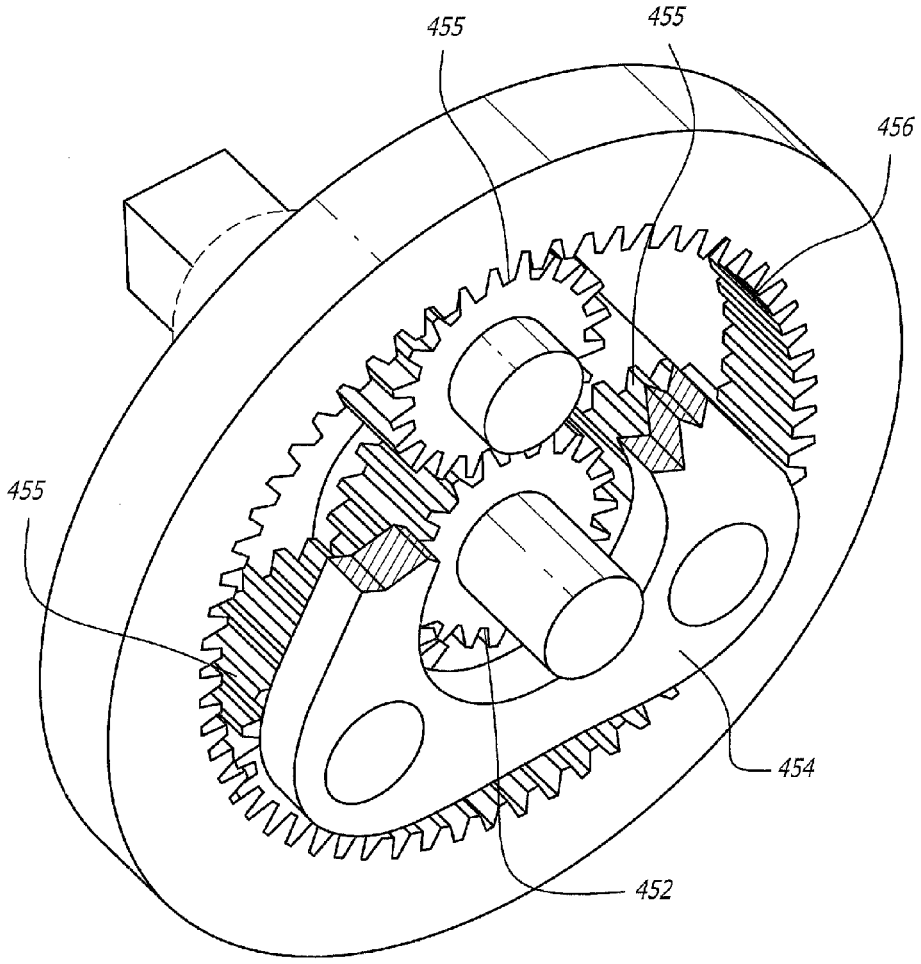

In some examples, the driveshaft 420 may be coupled to a planetary gear drive 450, illustrated in FIG. 4I. The planetary gear drive 450 may include a sun gear 452, configured to be arranged concentrically with and to be rotatable about the axis 402, a planetary carrier 454, configured to be coupled to the driveshaft 420 without relative rotational motion therebetween, pinion gears 455, rotatably coupled to the planetary carrier 454 and in mesh with the sun gear 452, a ring gear 456 in mesh with the pinion gears 455, and a mechanical interface 458 (FIG. 4A) fixed to the ring gear 456. By way of example, the planetary gear drive 450 may multiply an input torque provided by a drive device.

As best illustrated in FIGS. 4A-4B, the first socket 430 is configured to be coupled to the mechanical interface 458 of the planetary gear drive 450. The apparatus may include a retaining mechanism 460, configured to releasably couple the first socket 430 to the mechanical interface 458. In the example depicted in FIGS. 4A-4G, the retaining mechanism 460 includes a spring-loaded quick-release latch 462, which secures the first socket 430 to the mechanical interface 458 of the planetary gear drive 450.

In some examples, the apparatus 400 may include means for selectively preventing rotation of the first socket 430 when the driveshaft 420 is rotated. By way of example, a breaker bar 475 (FIG. 4G) may be coupled to the first socket 430, such than an operator of the apparatus can prevent initial rotation of the ring gear 456, to which the mechanical interface 458 and the first socket 430 are coupled. In alternate examples of the means for selectively preventing rotation of the first socket 430, a clamp or other mechanism, coupled to the first socket 430, may be used to prevent initial rotation of the ring gear 456.

As illustrated in FIG. 4H, a rotary drive device 470 may be coupled to the sun gear 452 to drive the planetary gear drive 450. The rotary drive device 470 is configured to operatively limit the torque input to the sun gear automatically when the predetermined torque is applied to the fitting 310, e.g., by a clutch or other suitable mechanism. The rotary drive device 470 may be configured to rotate in a direction opposite to that the fitting 310 is threaded.

Figure 5:
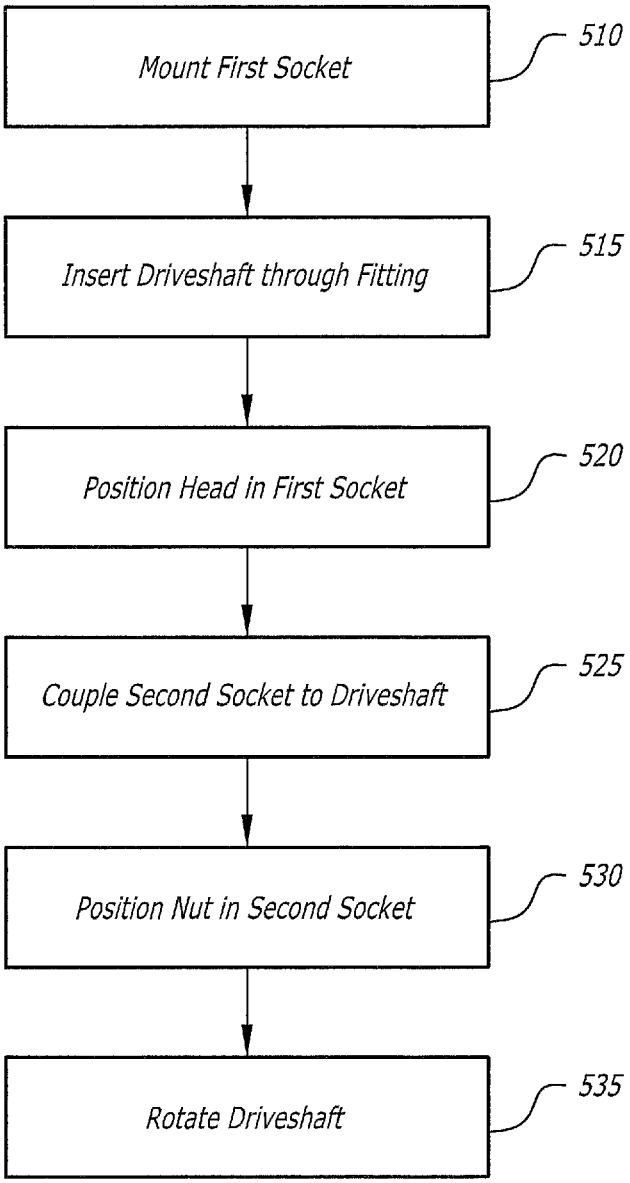
FIG. 5 is a flowchart illustrating operations in a method to torque fittings according to one or more aspects of the disclosure.

Having described structural components of an apparatus to torque fittings, aspects of methods to torque fittings will now be described with reference to FIG. 5. In use, the protective sleeve 304 may be positioned into the inner diameter of a fitting, e.g., the fitting 310, as illustrated in FIG. 3B. A first socket 430 may be mounted about the driveshaft 420 (operation 510) and secured to the mechanical interface 458 of the planetary gear drive 450 by causing the latch 462 of the retaining mechanism 460 to lock the first socket 430 to the interface 458, as illustrated in FIG. 4B. The driveshaft 420 may then be inserted through the inner diameter 316 of the fitting 310 (operation 515) and the first socket 430 may engage the head 312 of the fitting 310 (operation 520).

The second socket 440 may be coupled (operation 525) to the driveshaft 420, e.g., by inserting the driveshaft 420 through a corresponding opening in the socket 440, such that the flat surfaces 422 of the driveshaft mate with the complementary-shaped socket opening, coupling the second socket to the driveshaft without relative rotational motion therebetween. As a result, the nut 314 may be positioned in the second socket 440 (operation 530). At operation 535, the driveshaft 420 is rotated. In some examples, a drive device 470 may be coupled to the planetary gear drive 450 to rotate the driveshaft 420. Rotation of the driveshaft 420 introduces relative rotational motion between the head 312 and the nut 314, such that the fitting 310 may be tightened or loosened depending upon the direction of relative rotational motion and the threading of the fitting. In conventional practice, to tighten the fitting, the driveshaft 420 will rotate counterclockwise when viewed from the perspective of the drive device 470. When viewed from the opposite perspective, the nut 314 is being rotated clockwise, thereby tightening the nut 314 onto the head 312. Conversely, to loosen the fitting, the driveshaft 420 will rotate clockwise when viewed from the perspective of the drive device 470. When viewed from the opposite perspective, the nut 314 is being rotated counterclockwise, thereby loosening the nut 314 from the head 312. This description assumes that the fitting has right-hand threads. The opposite would be true if the fitting had left-hand threads. The drive device 470 may be reversible to effect both tightening and loosening of the fitting 310.

The planetary carrier 454 and, therefore, the driveshaft 420 and the second socket 440 will rotate in the direction of a torque applied to the sun gear 452 by the drive device 470 if the first socket 430, connected to the ring gear 456 via a mechanical interface 458, experiences resistance to its initial rotation, e.g., by using the breaker bar 475. Once the first socket 430 frictionally engages the bulkhead as the fitting 310 gets tighter, the socket 430 and, therefore the ring gear 456, remain stationary and the use of the breaker bar 475 is no longer required, since the torque circuit becomes a closed loop, thereby containing the reaction forces of the ring gear 456 within the fitting 310. If desired, the planetary gear drive 450 may be so constructed that the torque applied by the drive device 470 to the sun gear 452 is multiplied as it is transmitted by the shaft 420 to the nut 314 via the second socket 440.

Thus, the apparatus described herein provides a tool which enables fittings 310 to be torqued to a predetermined torque level using a single drive assembly that may be operated by a single operator. The apparatus is configured such that the moments generated by the opposing torques are contained within a closed torque loop, such that the net moment on the apparatus is approximately zero.

The respective components of the apparatus 400 may be formed from a suitably rigid material sufficiently strong to withstand the forces applied, e.g., a suitable metal or a high strength composite material.

In the foregoing discussion, specific implementations of illustrative processes have been described, however, it should be understood that in alternate implementation, certain acts need not be performed in the order described above. In alternate examples, some acts may be modified, performed in a different order, or may be omitted entirely, depending on the circumstances.

While various examples have been described, those skilled in the art will recognize modifications or variations which might be made without departing from the present disclosure. The examples illustrate the various aspects of the disclosure and are not intended to limit the present disclosure. Therefore, the description and claims should be interpreted liberally with only such limitation as is necessary in view of the pertinent prior art.

What is claimed is:

1. An apparatus comprising:

a driveshaft configured to be rotatable about an axis while the driveshaft is extended through a fitting and a workpiece;

a first socket configured to be coupled to the driveshaft concentrically with the axis and to couple to a head of the fitting on a first side of the workpiece; and a second socket configured to couple to the driveshaft on a second side of the workpiece and to couple to a nut that can be engaged with the fitting on the second side of the workpiece, wherein the second socket is configured to be rotatable relative to the first socket by the driveshaft, and wherein the second side is opposite of the first side.

2. The apparatus of claim 1, further comprising a drive device configured to rotate the driveshaft around the axis, wherein the first socket is configured to remain stationary while the driveshaft is rotated.

3. The apparatus of claim 2, further comprising a planetary gear drive coupled to the drive shaft and configured to couple to the drive device, wherein the planetary gear drive comprises:

a sun gear configured to be arranged concentrically with and to be rotatable about the axis;

a planetary carrier configured to be coupled to the driveshaft without relative rotational motion therebetween;

pinion gears rotatably coupled to the planetary carrier, wherein the pinion gears are in mesh with the sun gear;

a ring gear in mesh with the pinion gears; and a mechanical interface fixed to the ring gear, wherein the first socket is configured to be coupled to the mechanical interface without relative rotational motion between the socket and the ring gear.

4. The apparatus of claim 3, further comprising a retaining mechanism configured to couple the first socket to the mechanical interface.

5. The apparatus of claim 3, further comprising a rotary drive device configured to be operatively coupled to the sun gear, wherein the rotary drive device is configured to operatively disengage from the sun gear automatically when a predetermined torque is applied to the fitting.

6. The apparatus of claim 5, wherein the rotary drive device is selectively configured to rotate clockwise or counter-clockwise.

7. The apparatus of claim 1, further including a protective sleeve configured to extend through the fitting.

8. The apparatus of claim 1, wherein the driveshaft further comprises a first surface configured to engage the second socket.

9. The apparatus of claim 8, wherein the first surface comprises a flat surface.

10. The apparatus of claim 8, further comprising a retaining nut and wherein the driveshaft further comprises a curved surface configured to engage the retaining nut.

11. The apparatus of claim 10, wherein the curved surface extends along the axis.

12. The apparatus of claim 11, wherein the curved surface is adjacent the first surface and the first surface has a different curvature than the curved surface.

13. The apparatus of claim 1, wherein, when the first socket is fixed, rotating the driveshaft rotates the second socket relative to the first socket.

14. The apparatus of claim 1, further including means for selectively preventing rotation of the first socket.

15. A method comprising:

inserting a driveshaft through a head of a fitting;

engaging a first socket with the head on a first side of a workpiece, wherein the first socket is on the first side;

coupling a second socket to the driveshaft;

engaging the second socket with a nut engaged with the fitting on a second side of the workpiece, the second side opposite the first side, wherein the second socket is on the second side; and rotating the driveshaft and the second socket in a direction opposite to a threading direction of the fitting while preventing rotation of the first socket while the driveshaft extends through the fitting and the workpiece.

16. The method of claim 15, further comprising inserting a protective sleeve into the fitting before inserting the driveshaft through the head.

17. The method of claim 15, wherein the first socket is fixed and rotating the driveshaft rotates the second socket relative to the first socket.

18. The method of claim 15, wherein the driveshaft is coupled to a planetary gear drive comprising:

a sun gear configured to be arranged concentrically with and to be rotatable about an axis;

a planetary carrier configured to be coupled to the driveshaft without relative rotational motion therebetween;

pinion gears rotatably coupled to the planetary carrier, wherein the pinion gears are in mesh with the sun gear;

a ring gear in mesh with the pinion gears; and a mechanical interface fixed to the ring gear, wherein the first socket is configured to be coupled to the mechanical interface without relative rotational motion between the socket and the ring gear.

19. The method of claim 18, wherein:

the fitting is threaded such that rotating the nut in a first direction tightens the fitting; and the planetary gear drive rotates the driveshaft in the first direction to tighten the fitting.

20. The method of claim 19, wherein:

the fitting is threaded such that rotating the nut in a second direction loosens the fitting; and the planetary gear drive rotates the driveshaft in the second direction to loosen the fitting.

* * * * *